United States Patent [19]

Ragland, Jr.

[11] Patent Number: 4,572,983

[45] Date of Patent: Feb. 25, 1986

[54] COLOR PICTURE TUBE HAVING AN IMPROVED SUPPORT STRUCTURE FOR A COLOR SELECTION ELECTRODE

[75] Inventor: Frank R. Ragland, Jr., Lancaster, Pa.

[73] Assignee: RCA Corporation, Princeton, N.J.

[21] Appl. No.: 594,849

[22] Filed: Mar. 29, 1984

[51] Int. Cl.[4] ..... H01J 29/07

[52] U.S. Cl. ..... 313/405; 313/406; 313/407

[58] Field of Search ..... 313/402, 405, 406, 407

[56] References Cited

U.S. PATENT DOCUMENTS

| | | | |
|---|---|---|---|
| 3,617,787 | 11/1971 | Emmasingel | 313/85 |
| 3,700,948 | 10/1972 | Palac | 313/85 S |
| 3,754,157 | 8/1973 | Yamazaki et al. | 313/85 S |
| 3,803,436 | 4/1974 | Morrell | 313/85 S |
| 3,894,260 | 8/1975 | Sedivy | 313/405 |
| 3,896,071 | 10/1976 | Groot | 313/404 |
| 3,986,072 | 10/1976 | Adamski | 313/404 |
| 4,358,702 | 11/1982 | Gijrath et al. | 313/404 |
| 4,491,763 | 1/1985 | Fujinuma et al. | 313/405 |

FOREIGN PATENT DOCUMENTS

| | | | |
|---|---|---|---|
| 55-53852 | 4/1980 | Japan | 313/405 |

OTHER PUBLICATIONS

A. Morrell, H. Law, E. Ramberg and E. Herold, *Color Television Picture Tubes*, 100–102, 104–107, Academic Press, (1974).

*Primary Examiner*—Palmer C. DeMeo
*Assistant Examiner*—K. Wieder
*Attorney, Agent, or Firm*—Eugene M. Whitacre; Dennis H. Irlbeck; Vincent J. Coughlin, Jr.

[57] ABSTRACT

An improved color picture tube according to the invention includes an evacuated envelope enclosing a substantially rectangular cathodoluminescent screen, a color selection electrode suspended in register with the screen by a support structure, and an electron gun. The support structure includes a plurality of studs attached to the envelope adjacent to the corners of the screen. The support structure also includes a plurality of spring assemblies. Each spring assembly includes a first bimetal member attached to the color selection electrode and a second bimetal member having an aperture therein for engaging one of said studs. The first and second bimetal members provide longitudinal and rotational compensation, respectively, for maintaining the color selection electrode in register with the screen when the electrode and the spring assemblies are heated.

8 Claims, 8 Drawing Figures

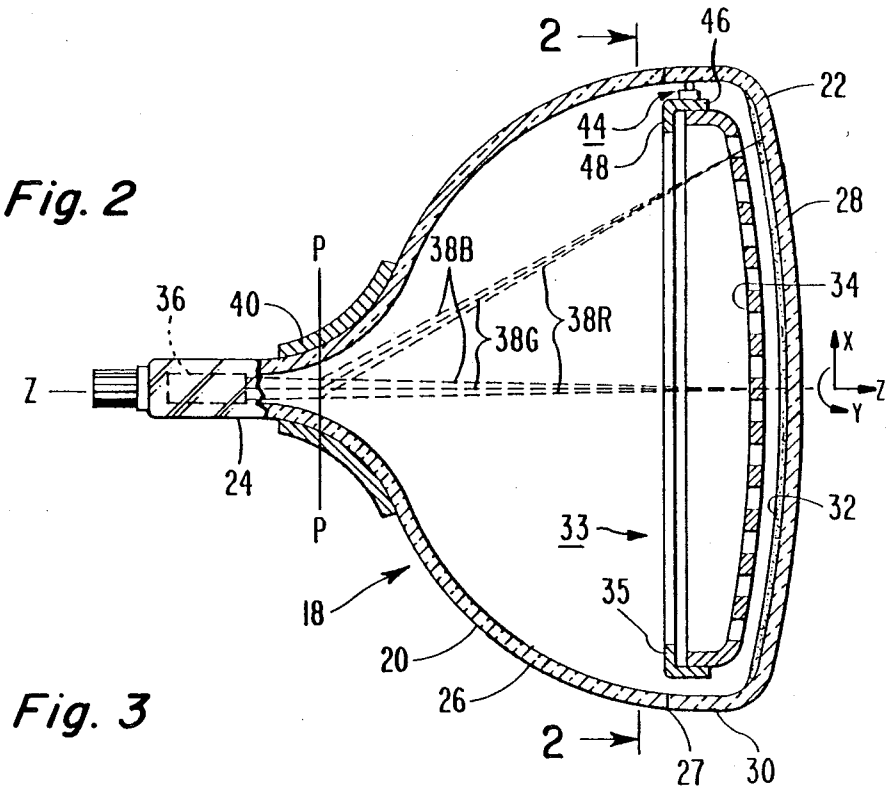
Fig. 1
Fig. 2
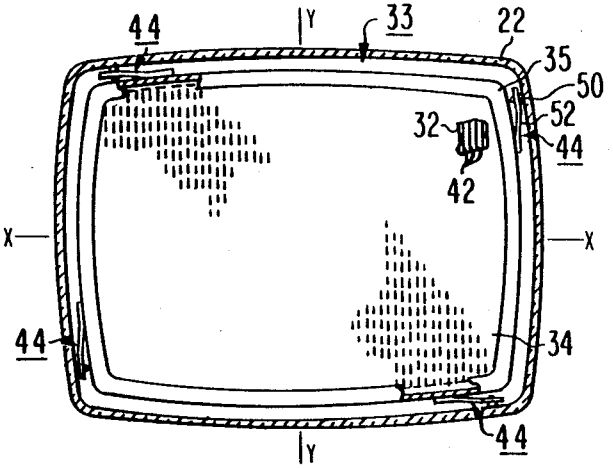
Fig. 3
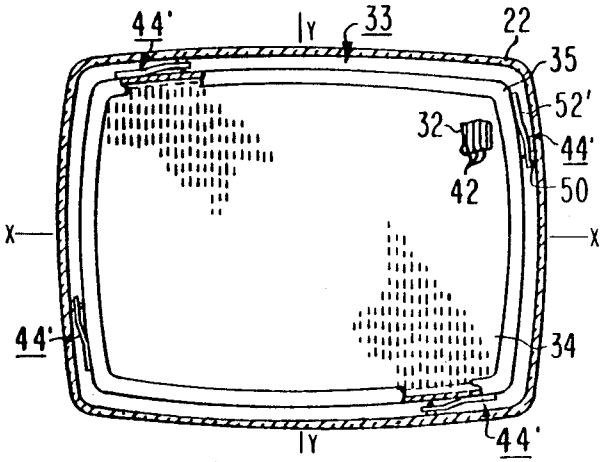

Fig. 5
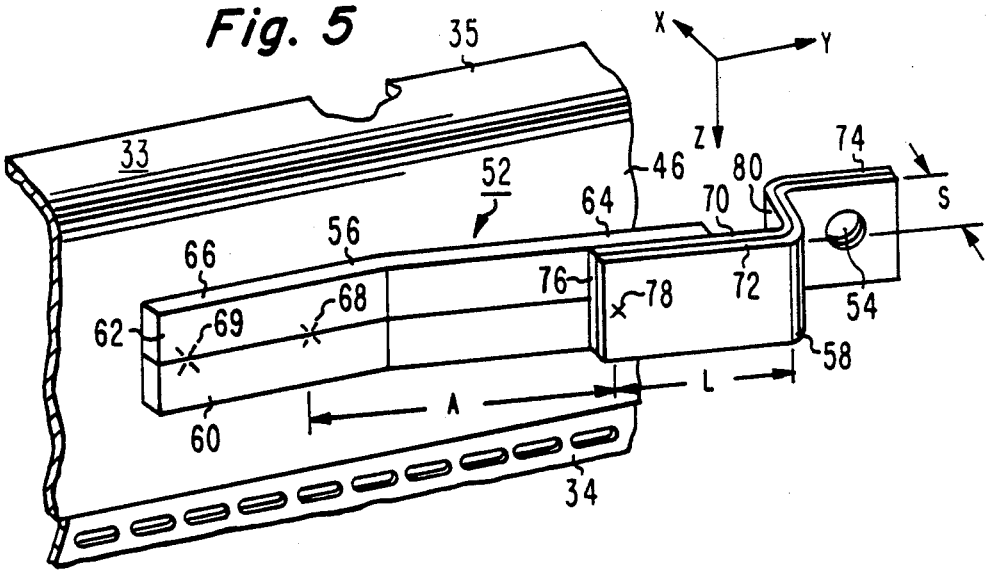
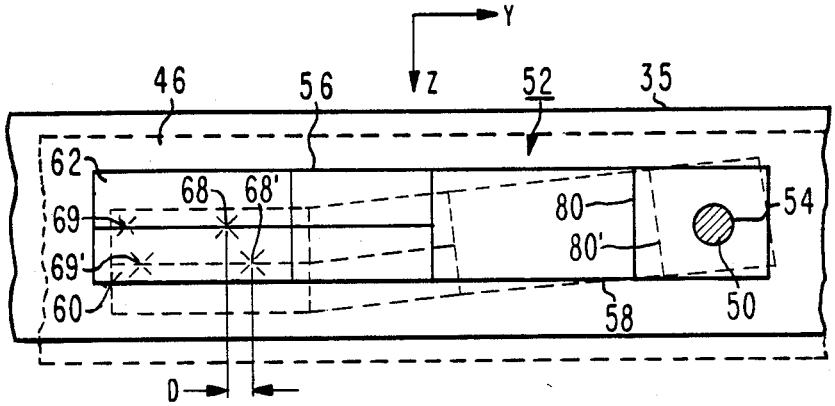
Fig. 6
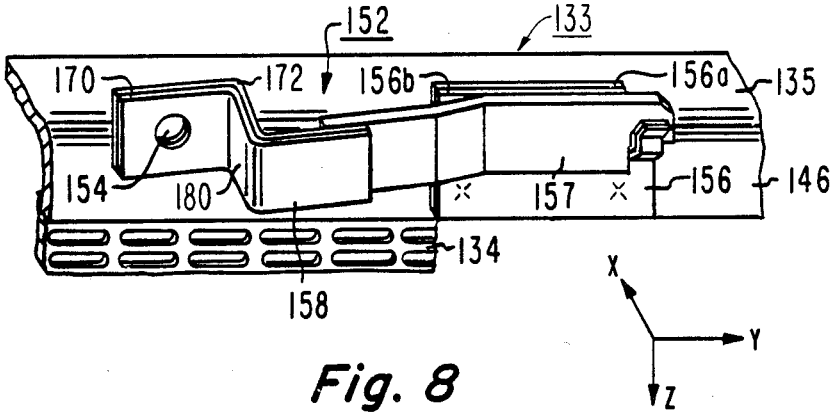
Fig. 8

COLOR PICTURE TUBE HAVING AN IMPROVED SUPPORT STRUCTURE FOR A COLOR SELECTION ELECTRODE

BACKGROUND OF THE INVENTION

This invention relates to color picture tubes of the type having a color selection electrode or shadow mask attached to a frame which is suspended in relation to a cathodoluminescent screen, and particularly to a support structure for suspending the mask-frame assembly within the tube.

In these color picture tubes, the accuracy with which the electron beams strike the individual elemental cathodoluminescent screen areas depends, to a great extent, upon the accuracy with which the apertures in the shadow mask are aligned with the elemental screen areas during the operation of the tube. Thus, as the mask expands outwardly, i.e., radially, by reason of thermal effects occasioned by the impact thereon of the electron beams, the resulting misalignment of the mask apertures and elemental screen areas cause a portion of the electron beams to misregister, that is, to impinge upon elemental screen areas other than the ones upon which they are intended to impinge.

Most present day color picture tubes utilize a mask mounting assembly, such as described in U.S. Pat. No. 3,803,436, issued to Morrell on Apr. 9, 1974, to move the mask longitudinally towards the screen, as the mask is heated, to compensate for radial mask expansion. In FIGS. 1–4 of the Morrell patent, bimetallic elements are connected between studs embedded in the faceplate panel and the mask electrode. The bimetallic elements may be springs welded directly to the frame or intermediate members located between the springs and the frame. In the Morrell patent, the studs are located along the major and minor axes of the faceplate panel. Such a structure produces some instability and loss of rigidity in the mask electrode. A more complete description of mask mounting structures and temperature compensation may be found in A. Morrell, H. Law, E. Ramberg and E. Herold, *Color Television Picture Tubes,* 100–102, 104–107 (Academic Press, 1974).

In a four-spring support arrangement, wherein each spring has the same orientation, e.g., all extending either clockwise or counterclockwise relative to the mask-frame assembly, thermal expansion of the springs and frame causes the mask-frame assembly to rotate about the longitudinal axis of the tube. This rotation also causes misregister of the electron beams with the elemental screen areas. The direction of rotation is determined by the location of the spring assemblies of the support structure relative to the major and minor axes of the faceplate panel. If the spring assemblies of the support structure are located to the right of the major and minor axes, the rotation will be oppositely directed, or clockwise. However, if the spring assemblies are located to the left of the axes, the rotation will be counterclockwise.

A structure which corrects the aforementioned problem of rotation while providing for thermal expansion of the mask-frame assembly along the longitudinal axis is proposed in U.S. Pat. No. 4,528,475 issued on July 9, 1985 to F. R. Ragland, Jr. In the structure in that patent, an edge-to-edge bimetallic spring is angled with respect to the frame such that the angle between the spring and the frame is of an amount to align the spring-to-frame attachment point when the spring and the frame are unheated with the same attachment point when the spring and the frame are heated. In the aforementioned patent, when four studs are used to support the mask-frame assembly, the studs are located adjacent to the major and minor axes of the faceplate panel. However, if the studs which support the mask-frame assembly were to be moved adjacent to the corners of the faceplate panel to increase the stability of the mask, it would be necessary to determine an angle for the springs attached along the long side of the faceplate and a different angle for the springs attached along the short side of the faceplate. The reason for the different spring angles is because of the difference in spacing from the major and minor axes to the corners of the rectangular faceplate.

Thus, to date, the problem of rotation in tubes having the mask assembly support studs located adjacent to the corners of the faceplate panel has not been fully addressed. The present invention provides an improvement in the various spring support systems so as to minimize or eliminate rotation while providing longitudinal compensation during tube operation.

SUMMARY OF THE INVENTION

An improved color picture tube according to the invention has a longitudinal axis and includes an evacuated envelope enclosing a substantially rectangular cathodoluminescent screen, a color selection electrode suspended in register with the screen by support means and an electron gun. The support means include a plurality of studs attached to the envelope adjacent to the corners of the screen and a plurality of spring assemblies. Each spring assembly includes a first bimetal member attached to the color selection electrode and a second bimetal member having an aperture therein for engaging one of said studs. The first and second bimetal members provide longitudinal and rotational compensation, respectively, for maintaining the color selection electrode in register with the screen when the electrode and the spring assemblies are heated.

BRIEF DESCRIPTION OF THE DRAWINGS

FIG. 1 is a plan view in axial section of an apertured mask cathode-ray tube (CRT).

FIG. 2 is a back view of the faceplate and mask-frame assembly of the tube of FIG. 1 having a counterclockwise oriented novel support structure adjacent to each of the corners of the faceplate.

FIG. 3 is a back view of the faceplate and mask-frame assembly of the tube of FIG. 1 having a clockwise oriented novel support structure adjacent to each of the corners of the faceplate.

FIG. 5 is an enlarged perspective view of an improved spring assembly of the novel support structure of FIG. 2 attached to the mask-frame assembly.

FIG. 6 is a side view of the novel support structure taken along line 6—6 of FIG. 4.

FIG. 8 is a perspective view of another embodiment of the novel spring assembly.

DETAILED DESCRIPTION OF THE PREFERRED EMBODIMENTS

Figure 4:
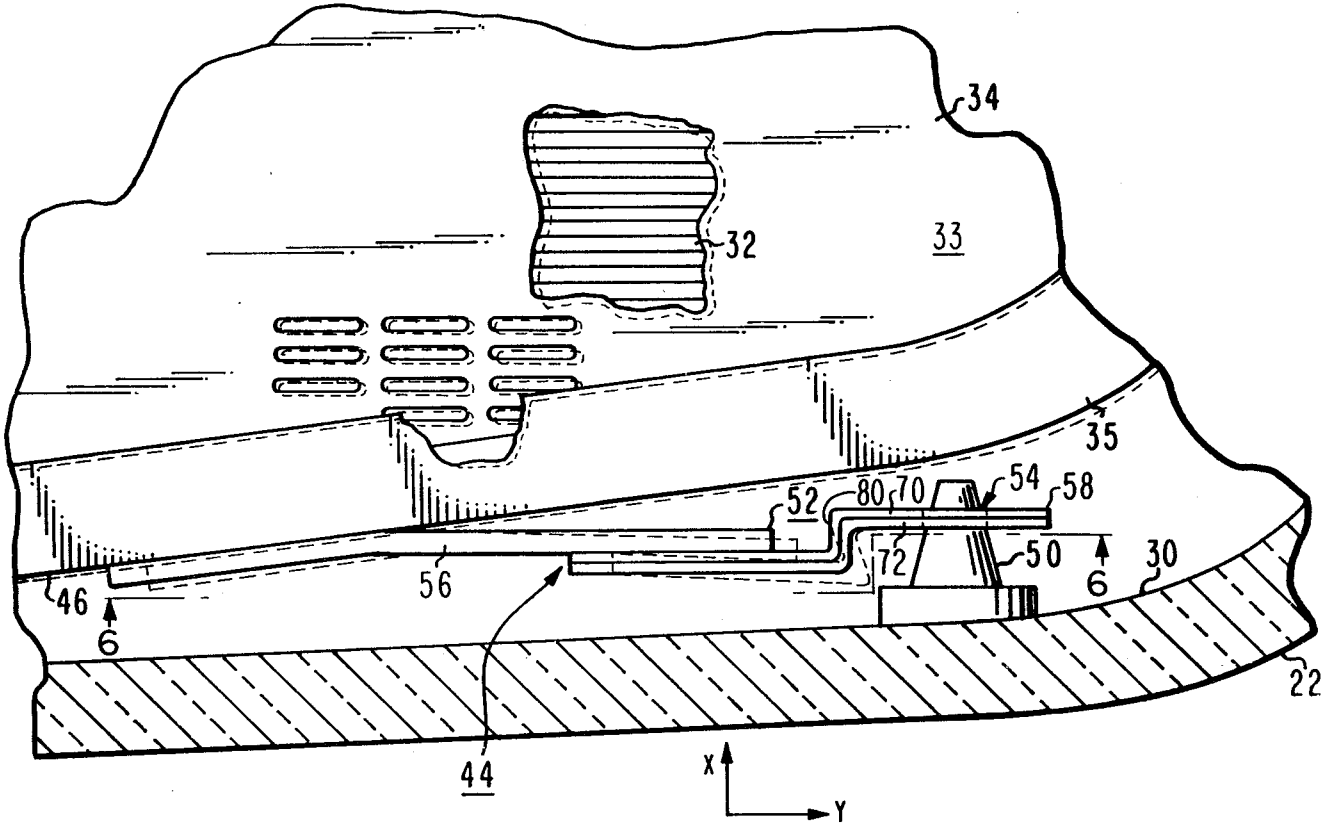
FIG. 4 is an enlarged plan view of a fragment of the structure of FIG. 2.

FIG. 1 illustrates a substantially rectangular color picture tube 18 having an evacuated glass envelope 20 comprising a faceplate panel 22 and a tubular neck 24 joined by a funnel 26. The panel 22, having a major axis (X—X) and a minor axis (Y—Y), comprises a viewing faceplate 28 and a peripheral flange or sidewall 30, which is sealed to the funnel 26 by a frit material 27. A substantially rectangular three-color cathodoluminescent line screen 32 is located on the inner surface of the faceplate 28. The screen 32 comprises an array of phosphor lines extending substantially parallel to the minor axis of the panel 22, so that the major and minor axes of the screen 32 are aligned with the major and minor axes of the panel. Portions of the screen 32 may be covered with a light-absorbing material (not shown) in a manner known in the art. A mask-frame assembly 33, comprising a multiapertured color selection electrode or shadow mask 34 made of cold-rolled steel having a thermal expansion of about $33\times10^{-6}$ centimeters per °C. at 20° C., is attached to a frame 35 of cold-rolled steel, having an L-shaped cross-section. The mask-frame assembly 33 is removably mounted within the panel 22 in predetermined spaced relationship to the screen 32. The mask-frame assembly 33 must be removed from the panel 22 several times in the process of fabricating the screen 32. A novel support structure for this mask-frame assembly 33 is described in detail below. The mask 34 includes a multiplicity of slit-shaped apertures, which are aligned in substantially parallel vertical columns, and web portions separating the slits of each column.

An inline electron gun 36 (illustrated schematically) is mounted within the neck 24 to generate and direct three inline electron beams 38B, 38R and 38G along convergent paths through the mask 34 to the screen 32. The longitudinal axis (Z—Z) of the tube 18 passes through the center of the electron gun 36 and through the center of the screen 32.

The tube 18 is designed to be used with an external magnetic deflection yoke 40 surrounding the neck 24 and funnel 26 in the vicinity of their junction. When appropriate voltages are applied to the yoke 40, the three beams 38B, 38R and 38G are subjected to orthogonal magnetic fields that cause the beams to scan in the direction of the major screen axis, and in the direction of the minor screen axis, in a rectangular raster over the screen 32. The major and minor axes of the screen 32 are mutually perpendicular to one another and to the longitudinal axis (Z—Z) of the tube 18. For simplicity, the actual curvature of the paths of the deflected beams in the deflection zone is not shown in FIG. 1. Instead, the beams are schematically shown as having an instantaneous bend at the plane of deflection (P—P).

A portion of the screen 32, partially covered by the mask 34, is illustrated in FIG. 2. The screen 32 comprises alternate lines 42 of red-, green- and blue-emitting phosphor elements. Also shown in FIG. 2 are four counterclockwise oriented novel mask-frame support means 44 (one of which is shown in FIG. 1) that suspend the mask-frame assembly 33 within the panel 22. Alternatively, four mask-frame support means 44' can be disposed in a clockwise orientation, as shown in FIG. 3.

The frame 35 has an L-shaped cross-section with a first flange 46 extending toward the screen 32 and a second flange 48 extending inwardly toward the longitudinal axis (Z—Z) of the tube 18, as shown in FIG. 1. The frame 35 lies in a plane which is transverse to the longitudinal axis (Z—Z) of the tube 18. The frame 35 is substantially rectangular and comprises two oppositely disposed long sides and two oppositely disposed short sides. As shown in FIG. 2, the center of each long side of the frame 35 is bisected by the minor axis (Y—Y) of the panel 22, and the center of each short side of the frame 35 is bisected by the major axis (X—X) of the panel 22. The frame 35 is generally thicker than the mask 34 to provide adequate support for the latter.

As shown in FIG. 4, each mask-frame support means 44 includes a conventional metal stud 50 embedded into the sidewall 30 of the panel 22 adjacent to one of the corners thereof, and a novel resilient spring assembly 52. Each spring assembly 52 is welded at one end to the first flange 46 of the frame 35. An aperture 54 is formed through the major surfaces of the spring assembly 52 at the other end thereof, as best shown in FIG. 5. The aperture 54 is pivotably disposed over the tapered end of the stud 50. The major surfaces of each spring assembly 52 lie in planes that are substantially parallel to the longitudinal axis (Z—Z) of the tube 18 and substantially perpendicular to the transverse plane (X-Y).

The novel spring assembly 52, shown in perspective in FIG. 5, comprises a first bimetal member 56 of edge-to-edge construction, and a second bimetal member 58 of laminated, contiguous layer construction. One rectangular strip 60 of the first bimetal member 56 has a higher coefficient of thermal expansion than the other rectangular strip 62. The strips 60 and 62 each have a given longitudinal axis and are secured together along adjacent edges, extending in a direction parallel to the longitudinal axis of each strip. The first bimetal member 56 has a distal end 64 and a proximal end 66 which is welded to the first flange 46 of the frame 35 at weld points 68 and 69. The second bimetal member 58 has a substantially rectangular configuration and includes a first layer 70, which has a lower coefficient of thermal expansion than the other layer 72 which is contiguous therewith. The layers 70 and 72 are joined together along facing major surfaces. The second bimetal member 58 has a distal end 74 with the aperture 54 formed therein, and a proximal end 76 which is attached, for example, by welding at a weld point 78 to the distal end 64 of the first bimetal member 56. The lower coefficient of expansion layer 70 of the second bimetal member 58 abuts the first bimetal member 56. Preferably, the long edges of the members 56 and 58 are parallel to one another. A step-like portion 80 of substantially constant width extends between the ends 74 and 76 of the second bimetal member 58. By way of illustration, and not limitation, in the preferred embodiment, the first bimetal member 56 has a thickness of about 0.76 mm (0.03 inches) and a width of about 1 cm (0.39 inches), with each of the strips 60 and 62 having equal width. The second bimetal member 58 has a thickness of about 0.76 mm (0.03 inches), equally divided between layers 70 and 72, and a width of about 1 cm (0.39 inches). The first bimetal member 56 has an active length, A, defined as the distance between weld points 68 and 78, of about 2 cm (0.79 inches). The second bimetal member 58 has an effective length, L, defined as the distance from the weld point 78 to the step portion 80, of about 2.5 cm (0.98 inches), and a step height, S, of about 3.05 mm (0.12 inches). The edge-to-edge bimetal of the first bimetal member 56 and the laminated bimetal of the second bimetal member 58 are formed of low expansion Invar (36% Ni, 64% Fe) and high expansion, non-magnetic stainless steel.

When the color picture tube 18 is operated, the mask-frame assembly 33 and the spring assemblies 52 expand due to the heat produced by electron bombardment. The expansion also causes a rotation of the four-corner supported mask-frame assembly 33, such that the centers of the short and long sides of the mask-frame assembly 33 are no longer aligned with the major and minor axes, respectively, of the panel 22. The expansion thus causes color impurity in the three-color picture on the screen 32 due to misalignment or misregister of the apertures in the mask 34 with the phosphor lines 42 on the screen. In order to eliminate or minimize such misregister, the spring assemblies 52 are adapted to cause the mask-frame assembly 33 to move toward the screen, while expanding outwardly and to move in a compensating direction to offset the clockwise rotation induced by the four-corner mounted shadow mask support structure.

With reference to FIGS. 4 and 6 when the mask-frame assembly 33 and the spring assembly 52 are heated by the impingement of the electron beams, they expand outwardly to the heated locations indicated by the dashed lines. The second bimetal member 58, comprising the lower coefficient of expansion layer 70 and the higher coefficient of expansion layer 72, will bend in the direction of the lower expansion layer 70. The step-like offset portion 80 will also bend in the direction of the lower expansion layer 70, but since the aperture 54 is pivotably engaged with the stud 50, the bending translates to a transverse displacement of the offset portion 80 to its heated location 80' which is clearly shown in FIG. 6. The displacement effectively moves the frame 35 such that weld points 68 and 69 are displaced a distance D to locations 68' and 69', respectively. The offset portion 80 effectively produces a displacement in the counterclockwise direction (i.e., to the right), which compensates for the normal clockwise rotation of the four-corner, mask-frame support means 44. Heating the spring assembly 52 also causes a bending in the first bimetal member 56 in the direction of the lower coefficient of expansion strip 62, as is shown in FIG. 6. Since the aperture 54 of the second bimetal member 58 pivots about the stud 50, the bending of the first bimetal member 56 causes the end of the spring assembly 52 that is welded to the first flange 46 of the frame 35 to move in the longitudinal direction Z toward the tube screen to the location indicated by the dashed lines. Thus, the first and second bimetal members 56 and 58, respectively, of spring assembly 52 act in concert to provide both longitudinal and transverse displacement of the shadow mask-frame assembly 33.

In a test performed with a temperature change of 30° C., and the spring assembly 52 having the parameters described herein, the spring assembly 52 expanded about 0.1 mm (0.004 inches) in the longitudinal or Z direction, i.e., toward the screen and contracted about 0.05 mm in a transverse direction, Y. The expansion toward the screen corrects for the expansion of the frame and mask. Since the aperture 54 pivotably encompasses the stud 50, the contraction in the transverse direction compensates for the rotation caused by the four-corner spring support structure. Thus, rotation of the mask can be compensated or at least minimized by using the novel spring assembly 52. Additional longitudinal compensation can be achieved by attaching the second bimetal member 58 to the first bimetal member 56 at an angle so that the long edges of the members 56 and 58 are not parallel to one another. However, such an arrangement increases the complexity of the support structure.

As shown in FIG. 3, the mask-frame support means 44' may also be affixed to the mask frame 35 in such a manner that the spring assemblies 52' are oriented in a clockwise manner. In this orientation, the weld points, which attach the first bimetal member 56 to the mask frame 35, are closer to the corner of the frame than in the embodiment of FIG. 2. Since the frame 35 is stiffer near the corners than along the sides, the orientation of FIG. 3 provides a sturdier support than that provided in FIG. 2. The studs 50 must be positioned, as shown in FIG. 3, to accommodate the clockwise orientation of the support means.

Figure 7:
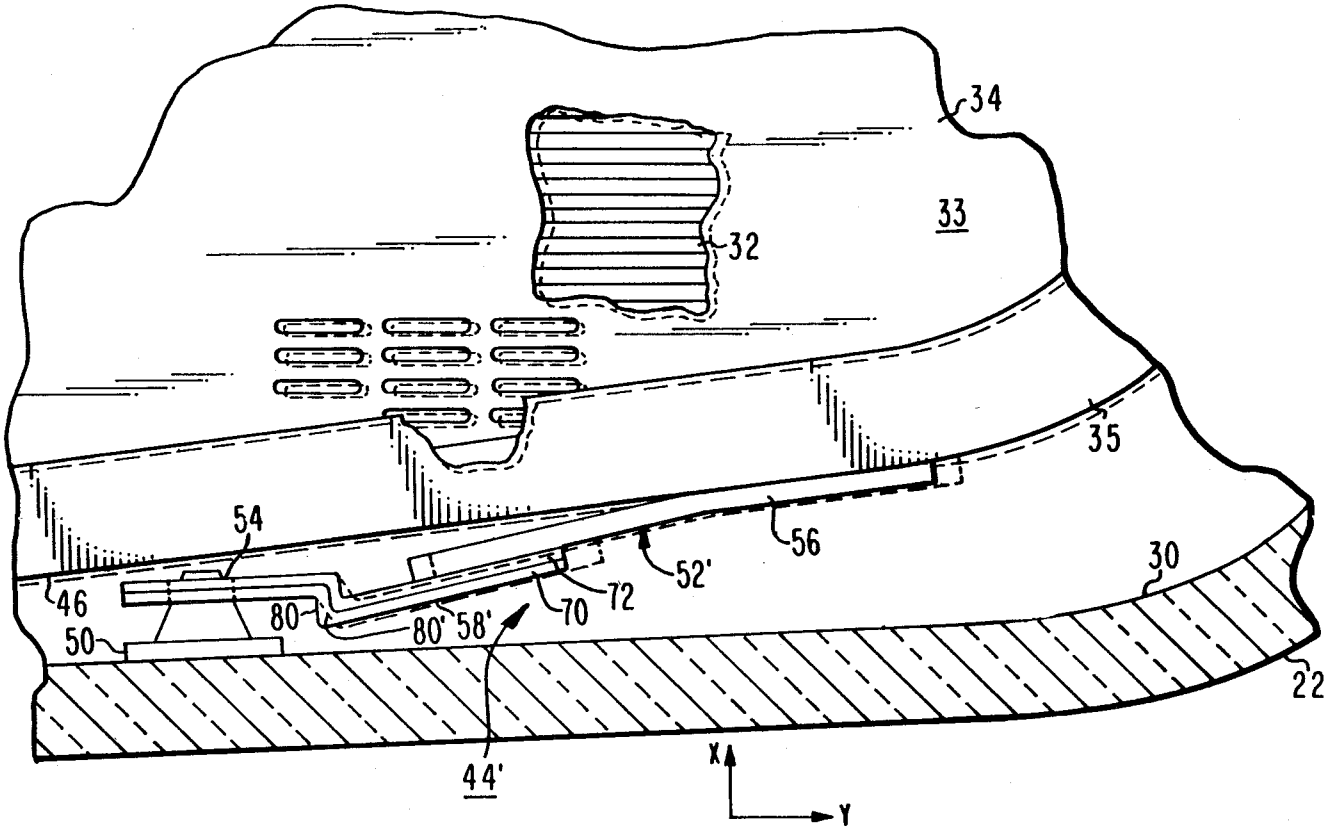
FIG. 7 is an enlarged plan view of a fragment of the structure of FIG. 3.

A mask-frame support means 44' is shown in FIG. 7. The support means 44' is similar to the above-described support means 44 and includes a conventional metal stud 50 embedded into the sidewall 30 of the panel 22 and a resilient spring assembly 52'. The spring assembly 52' comprises the above-described, first bimetal member 56 of edge-to-edge construction, and a second bimetal member 58' of laminated, contiguous layer construction. The second bimetal member 58' differs from the member 58 in that the second metal layer 72, which has a higher coefficient of thermal expansion than the first metal layer 70, abutts the first bimetal member 56. In other words, the bimetal layers 70 and 72 of the second bimetal member 58' are disposed opposite to those of member 58. As a result of the bimetal members 70 and 72 being reversed, when the electron beams impinge on the mask-frame assembly 33 and heat the mask-frame assembly and the spring assembly 52', they expand outwardly to the heated locations indicated by the dashed lines. The step-like offset portion 80 of the second bimetal member 58' bends in the direction of the lower expansion layer 70, but since the aperture 54 is pivotably engaged with the stud 50, the bending translates to a transverse displacement of the offset portion 80 to its heated position 80'. This displacement in the counterclockwise direction (i.e., to the right) compensates for the normal clockwise rotation of the four-corner, mask-frame support means 44', which are located to the right of the major and minor axes of the panel 22.

Another embodiment of a novel spring assembly 152 is shown in FIG. 8. The spring assembly 152 comprises a substantially rectangular strip-shaped first bimetal member 156 of laminated construction, which is fixedly attached, for example, by welding, to a side 146 of a frame 135. The bimetal member 156 includes a first portion **156*a* and a second portion 156*b* joined together along facing surfaces. The first portion 156*a* has a lower coefficient of thermal expansion and is positioned in contact with the frame 135. The second portion 156*b* has a higher coefficient of thermal expansion than portion 156*a* and is positioned to face the inner wall of the glass envelope (not shown). The facing surfaces of the first bimetal member 156 extend substantially parallel to the longitudinal axis (Z—Z) of the tube 18. A substantially rectangular leaf spring 157, having a longitudinal axis, is welded to the portion 156*b* of the bimetal member 156, so that the longitudinal axis of the leaf spring 157 is substantially parallel to the adjacent long edge of the bimetal member 156 and substantially perpendicular to the longitudinal axis of the tube. A second bimetal member 158 of laminated construction, comprising a first portion 170 and a second portion 172, are joined together along facing surfaces. The second bimetal member 158 has a rectangular configuration substantially identical to the previously described bimetal member 58', and a step-like portion 180 formed therein. The second bimetal member 158 is affixed to the free end of the leaf spring 157 so that the higher coefficient of thermal expansion portion 172 of the second bimetal member 158 is in contact with the leaf spring 157. Preferably, the long edges of the second bimetal member 158 are parallel to the longitudinal axis of the leaf spring 157. The lower coefficient of thermal expansion portion 170 of the second bimetal member 158 faces the inner wall of the glass envelope (not shown). A stud engaging aperture 154 is formed in the free end of the second bimetal member 158. When the mask-frame assembly 133 comprising shadow mask 134 and frame 135 expands, the first bimetal member 156 deflects inwardly toward the frame 135 urging the shadow mask 134 along the longitudinal axis (Z—Z) toward the screen (not shown). The step-like portion 180 of the second bimetal member 158 provides an expansion in the counterclockwise direction, as described for bimetal member 58', which compensates for the clockwise rotation of the mask-frame assembly 133** induced by the four-corner mounting structures which are located to the right of the major and minor axes of the faceplate panel (not shown).

What is claimed is:

1. In a color picture tube having a longitudinal axis, said tube including an evacuated envelope enclosing a substantially rectangular cathodoluminescent screen, a color selection electrode suspended in register with said screen by support means and an electron gun, said support means comprising a plurality of studs attached to said envelope adjacent to the corners of said screen and a plurality of spring assemblies connecting said color selection electrode and said studs, the improvement comprising each of said spring assemblies including a first bimetal member attached to said color selection electrode and a second bimetal member having an aperture therein for engaging one of said studs, said first and second bimetal members providing longitudinal and rotational compensation, respectively, for maintaining said color selection electrode in register with said screen when said electrode and said spring assemblies are heated.

2. In a color picture tube having a longitudinal axis, said tube including an evacuated envelope enclosing a substantially rectangular cathodoluminescent screen disposed across said axis at one end of said envelope, an electron gun mounted on said axis at the other end of said envelope, and an apertured mask attached to a frame which is disposed between said gun and said screen and suspended in register with said screen by support means, said support means including four studs attached to said envelope adjacent to the corners of said screen and four spring assemblies connecting said frame and said studs, the improvement comprising each of said spring assemblies including a first bimetal member attached at one end to said frame and a second bimetal member having an aperture therein for engaging one of said studs, said first and second bimetal members providing longitudinal and rotational compensation, respectively, for maintaining said apertured mask in register with said screen when said apertured mask, said frame and said spring assemblies are heated.

3. The tube as in claim 2, wherein said first bimetal member is of edge-to-edge construction comprising two strips of dissimilar metal each having a given longitudinal axis, said strips being joined along an edge extending in a direction parallel to the longitudinal axis of each strip, said second bimetal member being of laminated construction comprising two layers of dissimilar metal being joined along facing surfaces, said second bimetal member being attached to said first bimetal member, said second bimetal member having a step-like portion formed therein.

4. The tube as in claim 3, wherein the longitudinal axis of each of said strips comprising said first bimetal member is substantially perpendicular to the longitudinal axis of said tube.

5. The tube as in claim 2, wherein said first bimetal member is of laminated construction comprising two layers of dissimilar metal being joined along facing surfaces, said first bimetal member extending substantially parallel to the longitudinal axis of the tube, said second bimetal member being of laminated construction comprising two layers of dissimilar metal being joined along facing surfaces, said second bimetal member having a step-like portion formed therein, said first bimetal member and said second bimetal member being connected together by a leaf spring having a longitudinal axis which is substantially perpendicular to the longitudinal axis of the envelope.

6. In a color picture tube of the type including an evacuated envelope enclosing an electron gun, said envelope having a substantially rectangular faceplate panel comprising a viewing faceplate and a peripheral flange, said faceplate panel having an inner surface with a cathodoluminescent screen thereon, a color selection electrode attached to a frame which is suspended and registered in relation to said screen by support means, an axis passing through the center of said electron gun and the center of said screen being the longitudinal axis of said tube, said support means including four studs embedded in said peripheral flange of said faceplate panel, each of said studs being adjacent to a different one of the corners of said faceplate panel, and four spring assemblies each being engaged at one end with a different one of said studs and being connected at the other end to said frame, the improvement comprising each of said spring assemblies including a first bimetal member of edge-to-edge construction comprising two strips secured together along adjacent long edges and a second bimetal member comprising two contiguous, substantially rectangular layers laminated together, said first bimetal member being attached to said frame so that the long edges of said first bimetal member are substantially perpendicular to the longitudinal axis of said tube, said second bimetal member being attached at one end to said first bimetal member so that the long edges of said first and second bimetal members are substantially parallel, said first and second bimetal members providing longitudinal and rotational compensation, respectively, to maintain said color selection electrode in register with said screen when said spring assemblies and said frame are heated.

7. The tube as in claim 6 wherein said second bimetal member includes a step-like portion formed therein to provide said rotational compensation.

8. The tube as in claim 7 wherein said step-like portion has a substantially constant width.

* * * * *